US007635406B2

(12) United States Patent
Numata et al.

(10) Patent No.: US 7,635,406 B2
(45) Date of Patent: Dec. 22, 2009

(54) METHOD FOR MANUFACTURING A LOW ALLOY STEEL EXCELLENT IN CORROSION RESISTANCE

(75) Inventors: Mitsuhiro Numata, Kamisu (JP); Tomohiko Omura, Kishiwada (JP); Yoshihiko Higuchi, Toyonaka (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 274 days.

(21) Appl. No.: 11/523,070

(22) Filed: Sep. 19, 2006

(65) Prior Publication Data

US 2007/0012383 A1 Jan. 18, 2007

Related U.S. Application Data

(63) Continuation of application No. PCT/JP2005/005152, filed on Mar. 22, 2005.

(30) Foreign Application Priority Data

Mar. 24, 2004 (JP) ..... 2004-086042

(51) Int. Cl.
*C22C 38/28* (2006.01)
*C22C 38/22* (2006.01)
*C21C 7/00* (2006.01)

(52) U.S. Cl. ..... 75/570; 75/539; 75/526; 420/84; 420/85; 420/106; 420/110; 420/111

(58) Field of Classification Search ..... 148/320, 148/334; 420/84, 85, 129, 105, 106, 110, 420/111; 75/570, 539, 526
See application file for complete search history.

(56) References Cited

FOREIGN PATENT DOCUMENTS

| | | |
|---|---|---|
| JP | 2001-131698 | 5/2001 |
| JP | 2001-172739 | 6/2001 |
| JP | 2002-060893 | 2/2002 |
| JP | 2004-515653 | 5/2004 |
| WO | WO 03/083152 A1 | 10/2003 |

*Primary Examiner*—Deborah Yee
(74) *Attorney, Agent, or Firm*—Clark & Brody

(57) ABSTRACT

A low alloy steel, which has a chemical composition by mass %, of C: 0.1 to 0.55%, Si: 0.05 to 0.5%, Mn: 0.1 to 1%, S: 0.0001 to 0.005%, Al: 0.005 to 0.08%, Ti: 0.005 to 0.05%, Cr: 0.1 to 1.5%, Mo: 0.1 to 1%, O: 0.0004 to 0.005%, Ca: 0.0005 to 0.0045%, Nb: 0 to 0.1%, V: 0 to 0.5%, B: 0 to 0.005%, Zr: 0 to 0.10%, P≦0.03%, and N≦0.006%, with the balance being Fe and impurities, is manufactured by adjusting the value of ([Ti]/47.9)([N]/14)/([Ca])/40.1) satisfies not less than 0.0008 and not more than 0.0066, at the time of melting the said low alloy steel, wherein [Ti], [N] and [Ca] are the contents in the molten steel by mass % of Ti, N and Ca respectively. The thus-manufactured low steel alloy has a high SSC resistance with a yield stress of not less than 758 MPa.

1 Claim, 3 Drawing Sheets

METHOD FOR MANUFACTURING A LOW ALLOY STEEL EXCELLENT IN CORROSION RESISTANCE

This application is a continuation of the international application PCT/JP2005/005152 filed on Mar. 22, 2005, the entire content of which is herein incorporated by reference.

TECHNICAL FIELD

The present invention relates to a method for manufacturing a low alloy steel which is excellent in corrosion resistance. More specifically, the present invention relates to a method for manufacturing a low alloy steel excellent in corrosion resistance, particularly excellent in stress corrosion cracking resistance, which is suitable for applications to casings or tubings for oil wells or gas wells, drill pipes or drill collars for drilling and further petroleum plant piping and the like.

BACKGROUND ART

In recent years, oil wells or gas wells have been developed actively in severe environments where drilling was difficult. For example, development of a corrosive sour well which contains hydrogen sulfide and carbon dioxide in a large quantity or development of a deep well which reaches several thousands meters depth is increasingly activated.

For the drilling of such a sour well and the collection, transportation and storage of crude oil or natural gas, a steel which is excellent in corrosion resistance, particularly excellent in corrosion cracking resistance is needed. The stress corrosion cracking in an environment containing hydrogen sulfide is called sulfide stress cracking (hereinafter referred to as "SSC").

Further, for the deepening of the wells and the improvement in transportation efficiency, a steel with high strength is needed; however, a steel with higher strength is more likely to cause SSC.

Therefore, a demand for a steel which has both more excellent strength and sulfide stress cracking resistance (hereinafter referred to as "SSC resistance") than in the past has increased, and a steel or a steel pipe which has a higher strength and excellent SSC resistance is proposed in the Patent Documents 1 to 3, respectively.

It is disclosed in the Patent Document 1 that a technique for preventing the pitting, which starts from a coarse TiN, and consequently preventing the start of the SSC from the pitting be accomplished, by regulating the size and the precipitation amount of TiN, more specifically, by restricting the amount of TiN, which has a diameter of not less than 5 μm, to not more than 10 pieces per $mm^2$ of the cross section, in a high strength steel pipe which has a specified chemical composition and a yield stress (hereinafter also referred to as "YS") of not less than 758 MPa (110 ksi).

It is disclosed in the Patent Document 2 that a technique for obtaining a steel product which has a high strength of YS, between 738 and 820 MPa and excellent SSC resistance be developed, by regulating the properties of nonmetallic inclusions in a steel product which has a specified chemical composition, more specifically, by restricting the maximum length of the inclusions to not more than 80 μm and also the amount of the inclusions having a grain size of not less than 20 μm to not more than 10 pieces per 100 $mm^2$ of the cross section.

Further, it is disclosed in the Patent Document 3 that a technique for suppressing the generation of coarse carbonitrides of Ti, Nb and/or Zr be accomplished, by forming a composite inclusion which has a specified chemical composition and also has an inner core of a Ca—Al based oxysulfide and, formed around it, an outer shell of a carbonitride of Ti, Nb and/or Zr which has a long diameter of 7 μm or less, in the amount of not less than 10 pieces per 0.1 $mm^2$, and thereby preventing pitting from starting due to these inclusions, so as not to induce SSC starting from the pitting.

However, in the recent situation, even the techniques proposed in the Patent Documents 1 to 3 may be unable to respond to the industrial need of the development of a steel product having both high strength and increased SSC resistance.

That is to say, recently, a corrosion test in a further severe stress condition was increasingly imposed from the point of ensuring practical safety in addition to the increase in the strength of the steel products or steel pipes. The conventional target of the SSC resistance was to obtain a never fractured steel product with 758 MPa class (110 ksi class) specified minimum stress, when it was subjected to a constant load type SSC test regulated in the TM 0177-96A method of NACE (National Association of Corrosion Engineers), more specifically, when it was subjected to a constant load test with an applied stress of 80 to 85% of 758 MPa for 720 hours in an environment of 0.5% acetic acid+5% sodium chloride aqueous solution of 25° C. saturated with hydrogen sulfide of the partial pressure of 10132.5 Pa (0.1 atm).

Similarly, the conventional target of the SSC resistance was to obtain a never fractured steel product with 862 MPa class (125 ksi class) specified minimum stress, when it was subjected to a constant load test with an applied stress of 80 to 85% of 862 MPa for 720 hours in an environment of 0.5% acetic acid+5% sodium chloride aqueous solution of 25° C. saturated with hydrogen sulfide of the partial pressure of 3039.75 Pa (0.03 atm).

However, recently, it was requested that the SSC resistance, even the above-mentioned steel products, with a specified minimum stresses of 758 MPa class (110 ksi class) and 862 MPa class (125 ksi class) are never fractured when tested for 720 hours in the above-mentioned respective environments with application of the stress of 90% of YS actually possessed by each steel product (hereinafter also referred to as "actual YS"). In a condition with application of such a high stress close to the actual YS, it is difficult to suppress the SSC even if the hydrogen sulfide partial pressure is equal to or lower than the conventional condition, and it becomes more difficult to ensure the SSC resistance even with the techniques proposed in the Patent Documents 1 to 3.

In this way, the recent extremely severe test condition for the SSC resistance evaluation makes it difficult to simultaneously assign the high strength and increased SSC resistance requested for the steel products from the industry.

Patent Document 1: Japanese Laid-Open Patent Publication No. 2001-131698,

Patent Document 2: Japanese Laid-Open Patent Publication No. 2001-172739,

Patent Document 3: International Patent Publication Pamphlet No. WO 03/083152.

DISCLOSURE OF THE INVENTION

Problems to be Solved by the Invention

From the point of the above-mentioned present situation, it is an objective of the present invention to provide a method for stably manufacturing a low alloy steel, which has an excellent SSC resistance, such that no fracture is caused in a steel product with 758 MPa class (110 ksi class) specified minimum stress, even if subjected to a constant load type SSC test, with an applied stress of 90% of the actual YS of the steel product for 720 hours in an environment regulated by the TM 0177-96A method of NACE, namely, in an environment of 0.5% acetic acid+5% sodium chloride aqueous solution of 25° C. saturated with hydrogen sulfide of the partial pressure of 10132.5 Pa (0.1 atm), or no fracture is caused in a steel product with 862 MPa class (125 ksi class) specified minimum stress, even if subjected to a constant load type SSC test with a load stress of 90% of the actual YS of the steel product for 720 hours in an environment of 0.5% acetic acid+5% sodium chloride aqueous solution of 25° C. saturated with hydrogen sulfide of the partial pressure of 3039.75 Pa (0.03 atm).

Mean for Solving the Problems

The gist of the present invention is a method for manufacturing a low alloy steel, excellent in corrosion resistance, described in the following (i) and (ii).

(i) A method for manufacturing a low alloy steel, excellent in corrosion resistance, which comprises adjusting the value of fn1, represented by the following expression (1), so as to satisfy the following expression (2), at the time of melting the said low alloy steel, which has a chemical composition by mass %, of C: 0.1 to 0.55%, Si: 0.05 to 0.5%, Mn: 0.1 to 1%, S: 0.0001 to 0.005%, Al: 0.005 to 0.08%, Ti: 0.005 to 0.05%, Cr: 0.1 to 1.5%, Mo: 0.1 to 1%, O (oxygen): 0.0004 to 0.005%, Ca: 0.0005 to 0.0045%, Nb: 0 to 0.1%, V: 0 to 0.5%, B: 0 to 0.005%, Zr: 0 to 0.10%, P: not more than 0.03%, and N: not more than 0.006%, with the balance being Fe and impurities.

$$fn1=([Ti]/47.9)([N]/14)/([Ca]/40.1) \quad (1),$$

$$0.0008 \leqq fn1 \leqq 0.0066 \quad (2),$$

wherein, reference marks in the expression (1) are defined as follows:

[Ca]: Ca content in molten steel by mass %,

[Ti]: Ti content in molten steel by mass %,

[N]: N content in molten steel by mass %.

(ii) The method for manufacturing the low alloy steel, excellent in corrosion resistance, described above (i), wherein Ca is added at the time of melting of the steel so that values of fn3 and fn4 represented by the following expressions (3) and (4) satisfy the following expressions (5) and (6), respectively.

$$fn3=WCa/[Ti] \quad (3),$$

$$fn4=WCa/[N] \quad (4),$$

$$2.7 \leqq fn3 \leqq 14 \quad (5),$$

$$10 \leqq fn4 \leqq 68 \quad (6),$$

wherein, reference marks in the expressions (3) and (4) are defined as follows:

WCa: Adding amount of Ca per t (ton) of molten steel (kg/t),

[Ti]: Ti content in molten steel by mass %,

[N]: N content in molten steel by mass %.

The content of each element in the molten steel means a mass concentration in a sample collected by pumping or suction from a melting section, during the period after component adjustment, to completion of casting.

The above-mentioned inventions (i) and (ii), related to the method for manufacturing a low alloy steel, excellent in corrosion resistance are referred to as the invention (i) and the invention (ii), respectively. These inventions may be collectively referred to as the present invention.

EFFECT OF THE INVENTION

According to the method of the present invention, a low alloy steel having an extremely high SSC resistance with YS of not less than 758 MPa can be stably and surely obtained. Therefore, the low alloy steel obtained by the method of the present invention can be used as steel tocks for casings or tubings for oil wells or gas wells, drill pipes or drill collars for drilling and further for petroleum plant piping and the like, for which severe corrosion resistance, particularly severe SSC resistance, is requested.

BEST MODE FOR CARRYING OUT THE INVENTION

Figure 1:
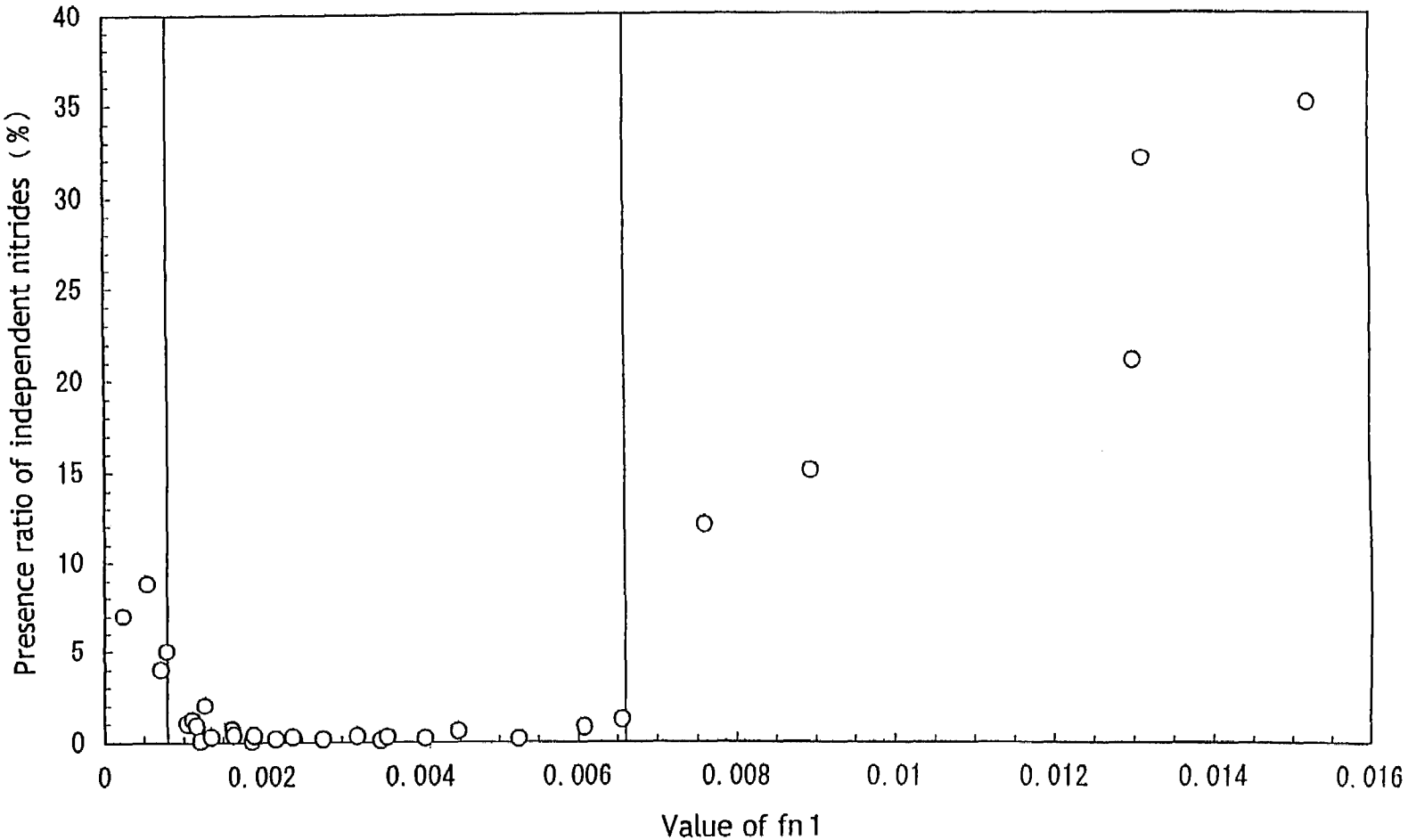
FIG. 1 is a graphic representation showing the relationship between the presence ratio of the independent Ti based nitrides (described as "presence ratio of independent nitrides" in the drawing) and the value of fn1 represented by the expression (1).

In order to solve the above-mentioned problem, according to the strength level of the steel products, the present inventors made detail examinations for fracture occurrence of various low alloy steels, having the chemical compositions and composite inclusions (namely, various low alloy steels having chemical compositions consisting of specified amounts of C, Si, Mn, S, O (oxygen), Al, Ca, Ti, Cr, Mo, Nb and P, or further including one or more of V, B and Zr in addition to the above-mentioned elements, and the balance substantially consisting of Fe, and also containing composite inclusions with a long diameter of not more than 7 μm, having an outer shell of a carbonitride of Ti, Nb and/or Nb on the circumference of a core of a Ca—Al based oxysulfide in the amount of not less than 10 pieces per 0.1 $mm^2$), proposed in the Patent Document 3 by one of the present inventors, by performing a constant load type SSC test, with applied stresses of 90% of YS actually possessed thereby, for 720 hours in an environment of 0.5% acetic acid+5% sodium chloride aqueous solution of 25° C., saturated with hydrogen sulfide of the partial pressure of 10132.5 Pa (0.1 atm) or 3039.75 Pa (0.03 atm) (the former environment with 10132.5 Pa of hydrogen sulfide partial pressure and the latter environment with 3039.75 Pa of hydrogen sulfide pressure may be referred to as "first environment" and "second environment", respectively). The composite inclusions in the above-mentioned various steels are adjusted by controlling the cooling rate from 1500 to 1000° C., at the time of casting the steel, to not more than 500° C./minute according to the method proposed by the Patent Document 3.

As a result, first, the following matter (a) was clarified.

(a) When the constant load type SSC test was performed with an applied stress of 90% of the actual YS of steel in the first environment or in the second environment according to the strength level, a high strength steel with YS of not less than 758 MPa may be fractured before the test time reaches 720 hours, even if adjusted, so as not to generate coarse carbonitrides of Ti, Nb and/or Zr.

Therefore, the SSC test was performed in the same condition, except for shortening only of the test time. As a result, the following important findings (b) to (f) were obtained.

(b) When the constant load type SSC test was performed to the high strength steel with YS of not less than 758 MPa, with the applied stress of 90% of the actual YS of the steel in the first environment or in the second environment according to the strength level, not only a coarse pitting but also a germinal extremely fine pitting can cause SSC.

(c) The fine pitting that causes SSC is a results of the Ti based nitride which is independently present in steel, particularly Ti based nitride independently present in a large size. When the Ti based nitride is present as a composite inclusion in which the Ti based nitride constitutes an outer shell, no SSC is started therefrom (the Ti based nitride present independently is referred to as "independent Ti based nitride" in this specification).

(d) In order to prevent the fracture of a high strength steel with YS of not less than 758 MPa, within 720 hours in the constant load type SSC test with application of a stress of 90% of YS actually possessed by the steel, in the first environment or in the second environment according to the strength level, it is important to not only control the steel to the chemical compositions and composite inclusions proposed in the Patent Document 3, but to also suppress the coarsening of the independent Ti based nitride or to suppress the generation of independent Ti based nitride itself, by making the Ti based nitride into the composite inclusion.

(e) The coarsening of the independent Ti based nitride can be suppressed by increasing the generation site thereof to finely disperse it.

(f) The independent Ti based nitride can be made into the composite inclusion by making the Ti based nitride constitute an outer shell while using an inclusion, generated prior to the Ti based nitride in molten steel as an inner core.

Ca based inclusions are generally known to be generated prior to the Ti based nitride in molten steel. Therefore, the application of the Ca—Al based oxysulfide, proposed in the Patent Document 3 to the inner core of the composite inclusion, was then examined.

The form of the Ca—Al based oxysulfide that forms the inner core of the composite inclusion is determined by a treatment which is carried out in the molten steel stage. However, even if the cooling rate in casting is adjusted, as described above, as a treatment in the molten steel stage, independent Ti based nitride of a large size may be formed, and it causes SSC in the above-mentioned severe test condition. Therefore, the shape of inclusion was controlled by adjusting the components in the molten steel stage. Therefore, examinations were made for an optimum treatment condition of the molten steel, capable of performing fine dispersion of the independent Ti based nitride, in addition to the suppression of generation of the coarse carbonitride, by forming a composite inclusion having an outer shell of a carbonitride of Ti, Nb and/or Nb on the circumference of the core of the Ca—Al based oxysulfide.

The contents of the examinations made by the present inventors will now be described.

Each of the Ti based nitrides, for example, Ti—N, Ti—Nb—N, Ti—Nb—Zr—N, and the like is based on TiN. Therefore, the generation of the Ti based nitride in the molten steel is shown as the product of [Ti] and [N], when [M] is the content of a component element M in the molten steel by mass %, and as the value of [Ti]×[N] is larger, the Ti based nitride would be more easily generated. The said Ti based nitride is also generated with the Ca—Al based oxysulfide as the inner core if it is preliminarily formed, similarly to the carbonitride of Ti, Nb and/or Zr as previously described. The formation of the Ca—Al based oxysulfide that forms the inner core of the Ti based nitride depends on the value of [Ca].

The value of [Ti]×[N] in the generation of a Ti based nitride or the value of [Ca] in the generation of the Ca—Al based oxysulfide can be substantially estimated from conventional research results. However, this estimation can only give a condition for independently generating the Ti based nitride and the Ca—Al based oxysulfide, without the correlation between them.

Therefore, a condition for stably generating the composite inclusion having an outer shell constituted by a Ti based nitride with a Ca—Al based oxysulfide as an inner core cannot be estimated from the conventional research results.

However, in the composite inclusion having an inner core of a Ca—Al based oxysulfide and an outer shell of a Ti based nitride, the Ca—Al based oxysulfide can be regarded as the generation site of the Ti based nitride. Therefore, as the Ca based oxysulfide is further increased, the generation site of the Ti based nitride also increases. In other words, the larger the [Ca] value is, the easier the dispersion of the Ti based nitride. On the other hand, the Ti based nitride that forms the outer shell is more easily generated as the value of [Ti]×[N] is larger, but if it exceeds a certain threshold value, the generation and dispersion to the Ca based oxysulfide may become rather difficult, resulting in the generation as an independent Ti based nitride.

It can be considered that the value of [Ca] suggests the generation site for the dispersion of the Ti based nitride forming the outer shell of the composite inclusion, and the value of [Ti]×[N] suggests the state where the Ti based nitride is independently generated before dispersion. In other words, the dispersion of the Ti based nitride forming the outer shell of the composite inclusion is further facilitated as the value of [Ca] increases, and the value of [Ti]×[N] decreases. That is to say, the value of [Ca] and the value of [Ti]×[N] have reversed effects on the dispersion of the Ti based nitride forming the outer shell of the composition.

Accordingly, the dispersion state of the Ti based nitride can be rearranged by use of ([Ti]×[N])/[Ca].

However, since Ti, N and Ca have different atomic weights, Ti which has the heaviest atomic weight may be evaluated excessively in the rearrangement by [M] that is the content of the component element M in the molten steel by mass %. Therefore, it was finally concluded that the dispersion state of Ti based nitride should be evaluated by the above-mentioned expression (1) using mole ratio.

The present inventions (i) and (ii) have been accomplished on the basis of the above-mentioned findings and examination results.

Each requirement of the present invention will next be described in detail. In the following description, the symbol "%" at the content of each element represents "% by mass".

(A) Chemical Compositions of a Steel

C: 0.1 to 0.55%

C is an element effective in enhancing hardenability and improving the strength of steel, and not less than 0.1% is required. On the other hand, when the content of C exceeds 0.55%, toughness deteriorates and also there is an increase in quenching crack sensitivity, therefore, the content of C is set from 0.1 to 0.55%. The preferable range of the C content is 0.2 to 0.35%.

Si: 0.05 to 0.5%

Si is an element having a deoxidizing effect. In order to obtain this effect, the content of Si must be set to not less than 0.05%. However, a content more than 0.5% causes a deterioration in toughness. Therefore, the content of Si is set from 0.05 to 0.5%. The preferable range of the Si content is 0.1 to 0.3%.

Mn: 0.1 to 1%

Mn is an element which has an effect of enhancing the hardenability of steel. In order to ensure this effect, a content of not less than 0.1% is necessary, however, when the content of Mn exceeds 1%, Mn is segregated to the grain boundary, and this causes a deterioration in toughness. Therefore, the content of Mn is set from 0.1 to 1%. The preferable range of the Mn content is 0.1 to 0.6%.

S: 0.0001 to 0.005%

S forms a Ca—Al based oxysulfide which is the generation site of Ti based nitride, however, this effect is minimized with a content of less than 0.0001%. On the other hand, when the content of S exceeds 0.005%, a fine MnS is formed, resulting in a deterioration of the corrosion resistance or SSC resistance. Therefore, the content of S is set from 0.0001 to 0.005%.

Al: 0.005 to 0.08%

Al is an element necessary for the deoxidation of the molten steel, and this effect cannot be obtained with a content of less than 0.005%. On the other hand, a content of Al more than 0.08% causes deterioration in toughness, therefore, the content of Al is set from 0.005 to 0.08%. The preferable range of the Al content is 0.02 to 0.06%.

Ti: 0.005 to 0.05%

Ti has the effect of forming a carbonitride on the circumference of the Ca—Al based oxysulfide and enhances the strength due to grain refinement or precipitation strengthening. In order to ensure the said effect, the content of Ti must be set to not less than 0.005%. However, when the content of Ti exceeds 0.05%, a Ti based oxide is formed in addition to the generation of TiN and the like, which is a coarse independent Ti based nitride causing a deterioration in SSC resistance. Therefore, the content of Ti is set from 0.005 to 0.05%. The preferable range of the Ti content is 0.015 to 0.03%.

Cr: 0.1 to 1.5%

Cr improves the hardenability and also enhances the tempering softening resistance of steel to enable high-temperature tempering treatment, thereby improving the SSC resistance. These effects can be obtained with a content of Cr of not less than 0.1%. On the other hand, a content of Cr more than 1.5% only leads to an increase in cost with the saturation of the said effect. Therefore, the content of Cr is set from 0.1 to 1.5%. The preferable range of the Cr content is 0.5 to 1.1%.

Mo: 0.1 to 1%

Mo improves the hardenability, however, a sufficient effect cannot be obtained with a content of less than 0.1%. On the other hand, when the content of Mo exceeds 1%, Mo carbides are precipitated at the time of tempering, causing a deterioration in toughness. Therefore, the content of Mo is set from 0.1 to 1%. The preferable range of the Mo content is 0.2 to 0.8%.

O (Oxygen): 0.0004 to 0.005%

A lower content of oxygen is more desirable from the viewpoint of the index of cleanliness, however, when the content of O is less than 0.0004%, the generation site of the independent Ti based nitride is excessively reduced, causing a coarsening of the said independent Ti based nitride. On the other hand, when the content of O exceeds 0.005%, the number of inclusions is increased, causing a surface flaw and the like. Therefore, the content of O is set from 0.0004 to 0.005%. The preferable range of the O content is 0.0007 to 0.0025%.

Ca: 0.0005 to 0.0045%

Ca has the effect of controlling the forms of oxides, nitrides and sulfides, however, when the content of Ca is less than 0.0005%, the said effect cannot be obtained sufficiently. On the other hand, a content of Ca more than 0.0045% may lead to formation of a CaS cluster in addition to the saturation of the above-mentioned effect. Therefore, the content of Ca is set from 0.0005 to 0.0045%. The preferable range of the Ca content is 0.0015 to 0.003%.

Nb: 0 to 0.1%

Nb may be optionally added. When added, it forms carbonitrides to effectively refine the microstructure. In order to definitely obtain such an effect, the content of Nb is preferably set to not less than 0.005%. However, a content of Nb more than 0.1% only leads to increase in cost with the saturation of the said effect. Therefore, the content of Nb is set from 0 to 0.1%. When Nb is added, the Nb content is further preferably set from 0.01 to 0.1%, and more preferably from 0.02 to 0.05%.

V: 0 to 0.5%

V may be optionally added. If added, it enhances the tempering softening resistance, whereby the SSC resistance can be effectively improved. In order to definitely obtain the said effect, the content of V is preferably set to not less than 0.03%. However, a content of V more than 0.5% leads to other problems such as a deterioration in toughness with the saturation of the said effect. Therefore, the content of V is set from 0 to 0.5%. When V is added, the V content is further preferably set from 0.05 to 0.5%, and more preferably from 0.1 to 0.3%.

B: 0 to 0.005%

B may be optionally added. When added, it enhances the hardenability to effectively improve the SSC resistance. In order to definitely obtain the said effect, the content of B is preferably set to not less than 0.0003%. However, when the content of B exceeds 0.005%, coarse borocarbides are generated, and the SSC resistance is rather deteriorated. Therefore, the content of B is set from 0 to 0.005%. When B is added, the B content is further preferably set from 0.0005 to 0.005%, and more preferably from 0.001 to 0.003%.

Zr: 0 to 0.10%

Zr may be optionally added. When added, it forms carbonitrides, similarly to Nb, which effectively refine the microstructure. In order to definitely obtain this effect, the content of Zr is preferably set to not less than 0.003%. However, a content of Zr more than 0.10% causes other problems such as a deterioration in toughness with the saturation of the said effect. Therefore, the content of Zr is set from 0 to 0.10%. When Zr is added, the Zr content is further preferably set from 0.005 to 0.10%, and more preferably from 0.01 to 0.05%.

P: not more than 0.03%

P is present in steel as an impurity and it deteriorates the pitting resistance. It also segregates in the grain boundaries, and deteriorates the toughness or SSC resistance, particularly when the content of P exceeds 0.03%, a marked deterioration in SSC resistance or toughness occurs. Therefore, the content of P is set to not more than 0.03%. The content of P is preferably as low as possible.

N: not more than 0.006%

N is present in steel as an impurity. When the content of N exceeds 0.006%, TiN that is a coarse independent Ti based nitride is formed even if the content of Ti is controlled, and a marked deterioration in SSC resistance appears. Therefore, the content of N is set to not more than 0.006%. It is noted that the preferable content of N is not more than 0.004%.

(B) Contents of Ca, Ti and N in Molten Steel

It is based on the results of the following experiments made by the present inventors that the value of fn1 represented by the expression (1) was regulated so as to satisfy the expression (2), namely, the value of fn1 be between 0.0008 and 0.0066.

The present inventors melted 1.5 t (ton) or 15 kg of various low alloy steels containing the elements of C to N in the above-mentioned ranges and the balance being Fe and impurities, while variously changing the contents of Ti, N and Ca in the molten steel, namely, [Ti], [N] and [Ca]. The quantitative analysis of [Ti], [N] and [Ca] were carried out with bomb samples by an ICP method. These molten steels were solidified in a cooling rate in casting set from 20 to 250° C./min in a temperature range of 1560 to 900° C.

Each steel ingot after solidification was heated to 1250° C. and then made into a plate 15 mm or 20 mm thick by performing hot forging and hot rolling in a general method.

A test piece having a thickness of 15 mm, a width of 15 mm and a length of 15 mm was cut from each of the thus-obtained plates, and embedded in a resin so that the section vertical to the rolling direction was a test plane, and after mirror-like polishing, the amount and the size of inclusions were examined and the composition analysis of the inclusions was also carried out by an EPMA. The area of the test plane is 10 mm×15 mm.

A noticeable point of the inclusion examination result was that the state of Ti based nitride was varied depending on the contents of the Ti, N and Ca in the molten steel, namely, [Ti], [N], and [Ca]. For example, in a certain condition, the Ti based nitride was present as a composite inclusion in which the Ti based nitride constituted an outer shell with the Ca—Al based oxysulfide as an inner core, when the amount and the size of the independent Ti based nitrides were reduced.

FIG. 1 shows the result of rearrangement of the presence ratio of the independent Ti based nitrides, which is defined by the following expression (7), with the value of fn1 represented by the said expression (1). In the vertical axis of FIG. 1, the presence ratio of the independent Ti based nitrides was described as "presence ratio of independent nitrides".

The presence ratio of the independent Ti based nitrides (%)=(the amount of the independent Ti based nitrides/the total amount of observed inclusions)×100 (7).

Figure 2:
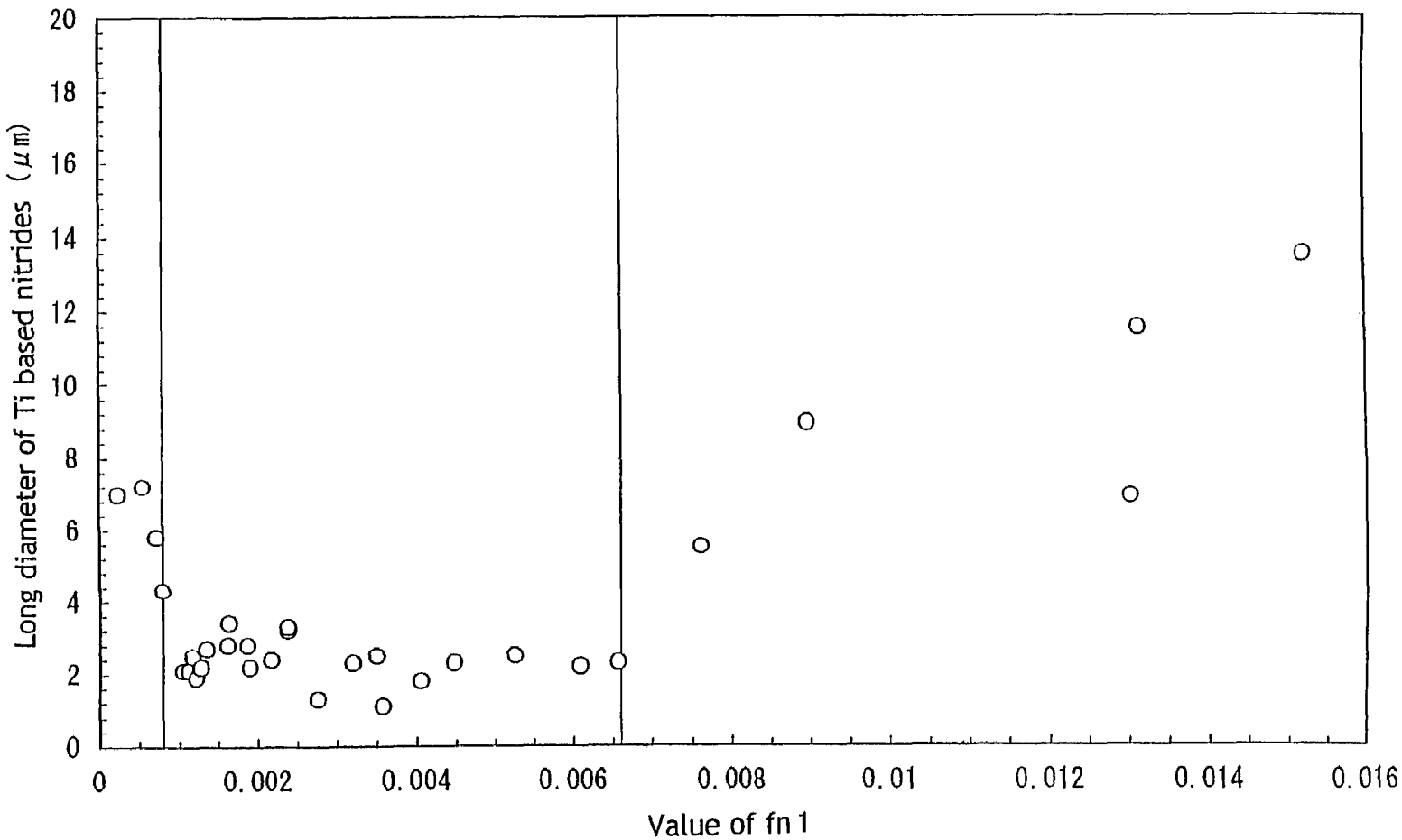
FIG. 2 is a graphic representation showing the relationship between the maximum diameter of the independent Ti based nitrides (described as "long diameter of Ti based nitrides" in the drawing) and the value of fn1 represented by the expression (1).

FIG. 2 shows the result of rearrangement of the maximum diameter of observed independent Ti based nitrides with the value of fn1 represented by the said expression (1). Here, the maximum diameter of the independent Ti based nitrides means the diameter or the diagonal length of the largest inclusion recognized in the observation of the above-mentioned test plane area by a SEM. In the vertical axis of FIG. 2, the maximum diameter of the independent Ti based nitrides was described as "long diameter of Ti based nitrides".

As is apparent from FIGS. 1 and 2, when the value of fn1, represented by the expression (1) exceeds 0.0066, the presence ratio of the independent Ti based nitrides, in other words, the amount thereof, rapidly increases, and the maximum diameter thereof also increases. On the other hand, when the value of fn1, represented by the expression (1) is less than 0.0008, the presence ratio of the independent Ti based nitrides, in other words, the amount thereof, slightly increases, and there is also a slight increase in the maximum diameter thereof. And as shown in examples described later, when the value of fn1 is more than 0.0066 and less than 0.0008, the SSC resistance is not good enough to ensure the SSC resistance intended by the present invention. Accordingly, in the said invention (i), the value of fn1 represented by the expression (1) was regulated so as to be not less than 0.0008 and not more than 0.0066, that is to say, in order to satisfy the said expression (2).

In a case that the value of fn1 represented by the expression (1) exceeds 0.0066, the presence ratio of the independent Ti based nitrides increases rapidly, and then, the maximum diameter thereof also increases. It may be attributed to the fact that the independent Ti based nitrides are generated beyond the generation of Ca—Al based oxysulfide because of extremely high [Ti] or [N], or to the fact that the Ca—Al based oxysulfide is minimized because of the low [Ca] and results in the insufficient generation sites of Ti based nitrides. On the other hand, the slight increase in the presence ratio of the independent Ti based nitrides with the slight increase in the maximum diameter thereof, in a case that the value of fn1 represented by the expression (1) is less than 0.0008, may be attributed to the influence of the composition of inclusions.

When the value of fn1 represented by the expression (1) satisfies the said expression (2), it is also apparent from FIG. 2 that the maximum diameter of the independent Ti based nitrides is small and never more than 4 μm.

Figure 3:
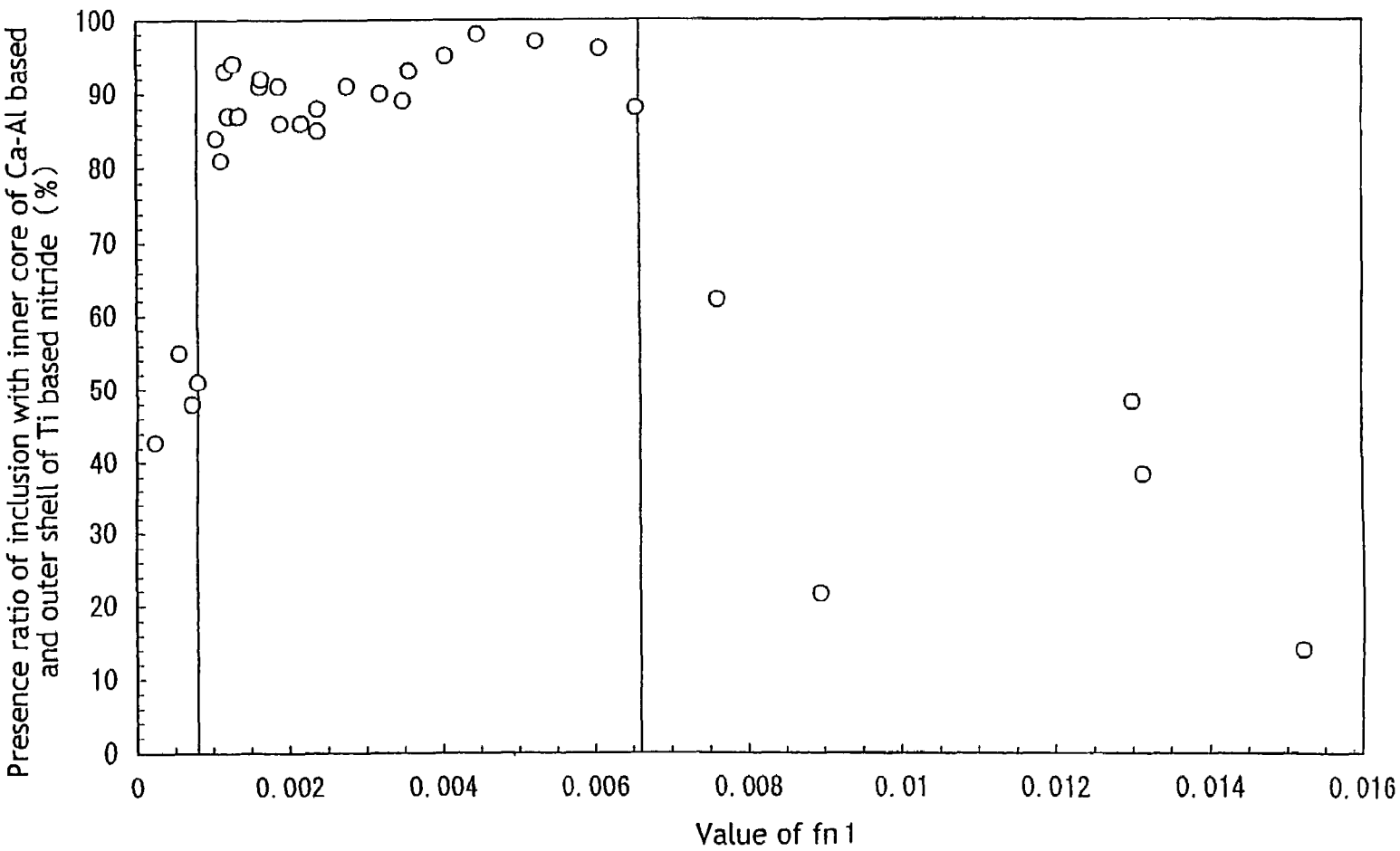
FIG. 3 is a graphic representation showing the relationship between the presence ratio of composite inclusions having an inner core of Ca—Al based oxysulfide and an outer shell of the Ti based nitride (described as "presence ratio of inclusion with inner core of Ca—Al base and outer shell of Ti based nitride" in the drawing) and the value of fn1 represented by the expression (1).

FIG. 3 shows the result of rearrangement of the presence ratio of composite inclusions, having an inner core of Ca—Al based oxysulfide and an outer shell of the Ti based nitride, which is defined by the following expression (8), with the value of fn1 represented by the said expression (1). In the vertical axis of FIG. 3, the presence ratio of the composite inclusions having the inner core of Ca—Al based oxysulfide and the outer shell of the Ti based nitride is described as "presence ratio of inclusion with inner core of Ca—Al based and outer shell of Ti based nitride".

The presence ratio of composite inclusions having the inner core of Ca—Al based oxysulfide and the outer shell of the Ti based nitride (%)=(the amount of composite inclusions having the inner core of Ca—Al based oxysulfide and the outer shell of the Ti based nitride/the total amount of observed inclusions)×100 (8).

It is apparent from FIG. 3 that the amount of composite inclusions, having the inner core of Ca—Al based oxysulfide and the outer shell of the Ti based nitride is increased when the value of fill represented by the expression (1) satisfies the said expression (2). This shows that the Ca—Al based oxysulfide can be effectively worked as the generation site of the Ti based nitrides when the value of fn1, represented by the expression (1), satisfies the above-mentioned expression (2), and consequently the size and the amount of the independent Ti based nitrides can be reduced.

(C) Addition of Ca in Melting a Steel

It is based on the results of the following experiments made by the present inventors that the values of fn3 and fn4 represented by the said expressions (3) and (4) are regulated so as to satisfy the said expressions (5) and (6), respectively, at the time of melting a steel, namely, so that the value of fn3 is not less than 2.7 and not more than 14, and the value of fn4 is not less than 10 and not more than 68.

That is to say, the adjustment of the molten steel components so that the value of fn1 represented by the expression (1) satisfies the said expression (2), at the time of melting a low alloy steel, which contains elements of C to N in the ranges described above and the balance being Fe and impurities can be attained, for example, by adding a specific amount of Ca, after narrowly controlling [Ti] and [N] by changing the addition amount of Ca, with the use of an apparent Ca yield based on an empirical rule according to the analysis values of [N]

and [Ti], or by adding Ti according to the analysis values of [Ca] and [N] after a Ca treatment. However, the methods mentioned above have problems of needing complicated works in application to industrial mass production and being inferior in accuracy because the content of Ca in the molten steel may be changed by evaporation of an excessive portion which is not reacted with inclusions even after the completion of inclusion control.

Therefore, the present inventors conducted experiments while changing the adding amount and the adding time of Ca in melting a steel, [Ti] and [N], in order to find a method enabling an easy and accurate treatment which is suitable for industrial mass production. They further examined the relationship of each of the said factors with the value of fn1 represented by the said expression (1). Since the Ca treatment can be influenced by a treatment scale, the experiments were carried out with two kinds of molten steels in the amount of 1.5 t (ton) and 15 kg. The relationship of the adding amount of Ca per t of molten steel (that is, WCa), [Ti] and [N] with the value of fn1 was determined.

The results of the experiments were rearranged with the value of fn1 relative to each value of fn3 and fn4. Now, the experimental results, which were added Ca at various stages after the component adjustments, are shown in Table 1. In Table 1, the values in italic show experimental results in the molten steel amount of 1.5 t, and those in Gothic show experimental results in the molten steel amount of 15 kg.

TABLE 1

| | | fn3 | | | | | | | | | | |
|---|---|---|---|---|---|---|---|---|---|---|---|---|
| | | 2.4 | 2.5 | 2.6 | 2.7 | 2.8 | 3.1 | 5.9 | 10.1 | 14.0 | 15.0 | 16.3 |
| fn4 | 8.0 | 0.00011 | 0.00020 | 0.00030 | 0.00032 | 0.00033 | 0.00028 | 0.00041 | 0.00045 | 0.00051 | 0.00690 | 0.00980 |
| | 9.0 | 0.00010 | *0.00022* | 0.00028 | 0.00041 | 0.00044 | 0.00043 | 0.00048 | 0.00051 | 0.00058 | 0.00710 | 0.01100 |
| | 10.0 | 0.00010 | 0.00025 | 0.00029 | 0.00081 | 0.00090 | 0.00100 | 0.00090 | *0.00080* | 0.00100 | 0.00670 | 0.00980 |
| | 13.8 | 0.00020 | 0.00026 | 0.00031 | 0.00093 | 0.00080 | *0.00100* | 0.00090 | 0.00090 | 0.00080 | 0.00690 | 0.00720 |
| | 15.1 | *0.00030* | *0.00027* | *0.00028* | *0.00092* | 0.00100 | *0.00110* | 0.00220 | 0.00230 | 0.00270 | 0.00710 | *0.00910* |
| | 25.5 | 0.00031 | 0.00033 | 0.00035 | 0.00091 | 0.00090 | 0.00160 | 0.00190 | *0.00220* | 0.00280 | *0.00740* | 0.00920 |
| | 34.5 | 0.00030 | 0.00028 | 0.00045 | 0.00150 | 0.00100 | 0.00150 | 0.00250 | 0.00270 | 0.00290 | 0.00710 | 0.00750 |
| | 48.5 | 0.00032 | 0.00024 | 0.00051 | 0.00180 | 0.00090 | 0.00180 | 0.00260 | 0.00280 | *0.00280* | *0.00770* | 0.00880 |
| | 51.2 | 0.00040 | 0.00041 | 0.00049 | 0.00220 | *0.00100* | 0.00220 | *0.00230* | 0.00250 | 0.00290 | 0.00880 | 0.00920 |
| | 57.5 | 0.00050 | 0.00051 | 0.00052 | 0.00350 | 0.00090 | 0.00280 | 0.00240 | *0.00290* | 0.00280 | 0.00870 | *0.00900* |
| | 61.3 | *0.00052* | *0.00049* | *0.00053* | *0.00420* | 0.00110 | 0.00500 | 0.00300 | 0.00330 | 0.00450 | *0.00780* | 0.01700 |
| | 68.0 | 0.00053 | 0.00055 | 0.00057 | 0.00590 | 0.00640 | *0.00660* | 0.00600 | 0.00650 | 0.00620 | 0.01200 | 0.01800 |
| | 70.3 | 0.00051 | 0.00061 | 0.00670 | 0.00710 | 0.00670 | 0.00720 | 0.00730 | 0.00760 | 0.00910 | 0.01300 | 0.01800 |
| | 72.1 | 0.00052 | 0.00062 | 0.00710 | 0.00780 | 0.00790 | 0.00740 | 0.00750 | 0.00810 | 0.00930 | 0.01500 | 0.01900 |
| | 74.3 | 0.00054 | 0.00068 | 0.00720 | 0.00820 | 0.00840 | 0.00860 | 0.00870 | 0.00830 | 0.00910 | 0.01600 | 0.01900 |

As is apparent from Table 1, if the values of fn3 and fn4 are within specified ranges, regardless of the molten steel amount and the Ca adding time after the component adjustments, the value of fn1 is not less than 0.0008 and not more than 0.0066, namely satisfies the said expression (2).

Therefore, in the said invention (ii), the values of fn3 and fn4 represented by the expressions (3) and (4) were regulated respectively so as to be not less than 2.7 and not more than 14, and to be not less than 10 and not more than 68, namely so as to satisfy the said expressions (5) and (6).

The present invention will be described, taking the case of melting and solidifying a low alloy steel by use of a converter, an RH vacuum degassing device and a continuous casting machine as an example.

First, a decarburization treatment is performed in the converter, and the molten steel is tapped to a ladle. It is desirable to perform the adjustment of the components other than Ca and Ti in the tapping or in a treatment by the RH vacuum degassing device which follows the tapping process. That is to say, it is desirable to complete the adjustment of the components other than Ca and Ti before the addition of these two components.

In the RH vacuum degassing device, reduction of [N] or reduction of [H] by degasification may be performed in addition to the component adjustments. Further, a temperature adjustment such as increasing the temperature may also be performed.

Furthermore, in the RH vacuum degassing device, it is desirable to reduce the O (oxygen) content in the molten steel (that is, [O]), by adjusting the circulating time of an inert gas. A deterioration in the index of cleanliness or generation of a large-sized oxide based inclusions causes nozzle clogging in casting, a destabilization of the Ca treatment, a surface flaw or the like. Therefore, the [O] before the Ca treatment is preferably reduced to not more than 35 mass ppm and more preferably to not more than 25 mass ppm by a treatment in the RH vacuum degassing device.

The Ca treatment, namely the addition of Ca to the molten steel, can be performed at any time before the completion of casting, but only after the component adjustments. For example, the addition may be performed in the ladle after the treatment in the RH vacuum degassing device, or performed in a tundish during continuous casting.

The addition of Ca to the molten steel can be performed by adding Ca or a Ca alloy collectively, by adding with powder top-blowing within a vacuum tank of the RH vacuum degassing device, by adding Ca through an injection method or a wire feeder method within the ladle, or by adding Ca through wire addition or blowing within the tundish; every adding method described above can be carried out. However, from the point of the stability of the Ca treatment, Ca is desirably added to the molten steel within the ladle or within the tundish. The Ca to be added can be not only pure Ca but also an alloy of Ca—Si, Ca—Al, Ca—Fe and the like.

At the time of casting the steel, the cooling rate from the liquidus line temperature to the solidus line temperature of a bloom center part is preferably set from 5 to 30° C./min.

The present invention will be described in more detail in reference to preferred embodiments.

Preferred Embodiment

After the decarburization in the converter, the molten steel components were adjusted to the chemical compositions shown in Tables 2 and 3 in the RH vacuum degassing device.

Successively, a Ca—Si alloy with 30% pure Ca was added to the molten steel in the ladle by an injection method. After that, the ladle was moved to the continuous casting machine, and the molten steel was made into a round billet with a diameter of 220 to 360 mm by continuous casting. In the casting, the cooling rate from the liquidus line temperature to the solidus line temperature of the bloom center part was from 10 to 15° C./min.

The steels A to P in Tables 2 and 3 are the steels related to the inventive examples. That is to say, these steel are manufactured so that the chemical components are within the ranges regulated by the present invention and adjusted to satisfy the said expression (2) at the time of melting. In manufacturing these steels, the adjustment for satisfying the expression (2) was performed, so that the values of fn3 and fn4 represented by the said expressions (3) and (4) for the adding amount of Ca satisfy the said expressions (5) and (6), respectively.

On the other hand, the steels Q to X in Tables 2 and 3 are the steels related to the comparative examples, which were not adjusted to satisfy the said expression (2) at the time of melting. Among these steels, the content of N in the steel T is also out of the range regulated by the present invention.

TABLE 2

| | | Chemical composition (% by mass) | | | | | | | | | |
|---|---|---|---|---|---|---|---|---|---|---|---|
| Class. | Steel | C | Si | Mn | P | S | Al | Ti | Ca | Cr | Mo |
| Inventive Example | A | 0.27 | 0.27 | 0.40 | 0.0041 | 0.0008 | 0.031 | 0.014 | 0.0022 | 1.01 | 0.71 |
| | B | 0.28 | 0.30 | 0.44 | 0.0033 | 0.0005 | 0.035 | 0.013 | 0.0018 | 0.51 | 0.72 |
| | C | 0.34 | 0.28 | 0.43 | 0.0051 | 0.0011 | 0.033 | 0.018 | 0.0015 | 1.02 | 0.71 |
| | D | 0.21 | 0.27 | 0.41 | 0.0042 | 0.0009 | 0.032 | 0.015 | 0.0021 | 0.52 | 0.73 |
| | E | 0.36 | 0.26 | 0.43 | 0.0022 | 0.0031 | 0.035 | 0.016 | 0.0016 | 1.01 | 0.31 |
| | F | 0.23 | 0.11 | 0.11 | 0.0020 | 0.0009 | 0.028 | 0.010 | 0.0030 | 0.52 | 0.28 |
| | G | 0.35 | 0.27 | 0.41 | 0.0041 | 0.0031 | 0.022 | 0.011 | 0.0023 | 1.02 | 0.69 |
| | H | 0.28 | 0.21 | 0.43 | 0.0045 | 0.0018 | 0.036 | 0.016 | 0.0020 | 0.98 | 0.71 |
| | I | 0.43 | 0.11 | 0.40 | 0.0081 | 0.0022 | 0.035 | 0.015 | 0.0021 | 1.28 | 0.78 |
| | J | 0.27 | 0.20 | 0.45 | 0.0033 | 0.0019 | 0.033 | 0.013 | 0.0028 | 1.03 | 0.73 |
| | K | 0.26 | 0.21 | 0.44 | 0.0033 | 0.0023 | 0.034 | 0.012 | 0.0014 | 1.02 | 0.71 |
| | L | 0.27 | 0.23 | 0.41 | 0.0032 | 0.0009 | 0.028 | 0.015 | 0.0021 | 1.01 | 0.72 |
| | M | 0.27 | 0.23 | 0.48 | 0.0041 | 0.0024 | 0.030 | 0.025 | 0.0022 | 1.02 | 0.74 |
| | N | 0.28 | 0.22 | 0.43 | 0.0050 | 0.0023 | 0.028 | 0.014 | 0.0023 | 1.04 | 0.73 |
| | O | 0.27 | 0.25 | 0.45 | 0.0031 | 0.0021 | 0.031 | 0.015 | 0.0021 | 0.97 | 0.72 |
| | P | 0.27 | 0.28 | 0.32 | 0.0021 | 0.0018 | 0.030 | 0.014 | 0.0012 | 1.02 | 0.71 |
| Comparative Example | Q | 0.28 | 0.25 | 0.40 | 0.0028 | 0.0012 | 0.029 | 0.014 | 0.0035 | 0.99 | 0.71 |
| | R | 0.26 | 0.21 | 0.45 | 0.0033 | 0.0023 | 0.033 | 0.015 | 0.0049 | 0.98 | 0.71 |
| | S | 0.27 | 0.20 | 0.51 | 0.0031 | 0.0031 | 0.031 | 0.008 | 0.0028 | 1.01 | 0.69 |
| | T | 0.45 | 0.11 | 0.22 | 0.0028 | 0.0012 | 0.030 | 0.021 | 0.0004 | 1.21 | 0.68 |
| | U | 0.23 | 0.31 | 0.41 | 0.0020 | 0.0011 | 0.028 | 0.044 | 0.0015 | 1.01 | 0.53 |
| | V | 0.35 | 0.29 | 0.40 | 0.0018 | 0.0021 | 0.030 | 0.009 | 0.0031 | 0.49 | 0.33 |
| | W | 0.28 | 0.29 | 0.21 | 0.0022 | 0.0015 | 0.032 | 0.015 | 0.0049 | 0.51 | 0.73 |
| | X | 0.25 | 0.16 | 0.65 | 0.0081 | 0.0010 | 0.026 | 0.012 | 0.0038 | 1.08 | 0.45 |

TABLE 3

Table 3 (continued from Table 2)

| | | Chemical composition (% by mass) Balance: Fe and impurities | | | | | | | | | |
|---|---|---|---|---|---|---|---|---|---|---|---|
| Class. | Steel | Nb | V | B | Zr | N | O | fn1 | WCa | fn3 | fn4 |
| Inventive Example | A | 0.035 | — | 0.0015 | — | 0.0032 | 0.0033 | 0.001217688 | 0.19 | 13.6 | 59.4 |
| | B | 0.007 | 0.09 | 0.0012 | — | 0.0034 | 0.0022 | 0.001468353 | 0.11 | 8.5 | 32.4 |
| | C | 0.031 | — | — | — | 0.0031 | 0.0031 | 0.002224456 | 0.07 | 3.9 | 22.6 |
| | D | 0.005 | — | 0.0011 | — | 0.0048 | 0.0024 | 0.002050190 | 0.18 | 12.0 | 37.5 |
| | E | 0.023 | 0.10 | — | 0.015 | 0.0044 | 0.0036 | 0.002631077 | 0.07 | 4.4 | 15.9 |
| | F | 0.005 | 0.05 | 0.0011 | 0.007 | 0.0051 | 0.0020 | 0.001016552 | 0.14 | 14.0 | 27.5 |
| | G | 0.011 | — | — | 0.008 | 0.0049 | 0.0019 | 0.001401334 | 0.15 | 13.6 | 30.6 |
| | H | 0.028 | — | 0.0013 | — | 0.0044 | 0.0022 | 0.002104861 | 0.15 | 9.4 | 34.1 |
| | I | 0.036 | 0.26 | — | — | 0.0041 | 0.0023 | 0.001751204 | 0.16 | 10.7 | 39.0 |
| | J | 0.031 | — | 0.0008 | 0.011 | 0.0039 | 0.0022 | 0.001082756 | 0.18 | 13.8 | 46.2 |
| | K | 0.025 | — | 0.0014 | — | 0.0051 | 0.0021 | 0.002613992 | 0.11 | 9.2 | 21.6 |
| | L | 0.024 | — | 0.0013 | — | 0.0045 | 0.0032 | 0.001922053 | 0.19 | 12.7 | 42.2 |
| | M | 0.021 | — | 0.0009 | — | 0.0051 | 0.0023 | 0.003465519 | 0.08 | 3.2 | 15.7 |
| | N | 0.023 | — | 0.0011 | — | 0.0022 | 0.0021 | 0.000800762 | 0.14 | 10.0 | 63.6 |
| | O | 0.024 | — | 0.0011 | — | 0.0048 | 0.0018 | 0.002050190 | 0.11 | 7.3 | 14.1 |
| | P | 0.010 | — | — | — | 0.0051 | 0.0033 | 0.003557933 | 0.07 | 5.0 | 13.7 |

TABLE 3-continued

Table 3 (continued from Table 2)

| Class. | Steel | Chemical composition (% by mass) Balance: Fe and impurities | | | | | | | | | |
|---|---|---|---|---|---|---|---|---|---|---|---|
| | | Nb | V | B | Zr | N | O | fn1 | WCa | fn3 | fn4 |
| Comparative Example | Q | 0.031 | — | 0.0010 | — | 0.0031 | 0.0020 | *0.000741485 | 0.25 | #17.9 | #80.6 |
| | R | 0.023 | — | 0.0012 | — | 0.0041 | 0.0019 | *0.000750516 | 0.3 | #20.0 | #73.2 |
| | S | 0.025 | — | 0.0013 | — | 0.0041 | 0.0022 | *0.000700481 | 0.2 | #37.5 | #73.2 |
| | T | 0.035 | 0.24 | — | — | *0.0141 | 0.0050 | *0.044264875 | 0.05 | #2.4 | #3.5 |
| | U | 0.032 | — | 0.0011 | — | 0.0043 | 0.0028 | *0.007542420 | 0.004 | #0.9 | #9.3 |
| | V | 0.011 | — | — | — | 0.0039 | 0.0020 | *0.000677059 | 0.28 | #31.1 | #71.8 |
| | W | 0.011 | 0.10 | 0.0012 | — | 0.0041 | 0.0029 | *0.000750516 | 0.28 | #18.7 | #68.3 |
| | X | 0.005 | — | 0.0012 | — | 0.0028 | 0.0030 | *0.000528733 | 0.23 | #19.2 | #82.1 |

A symbol "*" indicates falling outside the ranges specified by the present invention (i), and a symbol "#" indicates falling outside the ranges specified by the present invention (ii).

Each of the thus-obtained round billets was subjected to piercing rolling by a piercer, elongation milling by a mandrel mill, and a dimensional adjustment by a stretch reducer in a general method in order to produce a seamless steel pipe with an outer diameter of 244.5 mm and a wall thickness of 13.8 mm. This seamless steel pipe was heated to 920° C. followed by quenching, and further tempered at various temperatures of not higher than the $Ac_1$ point, whereby the strength level was adjusted, with respect to the steels A to X, to 758 MPa class (110 ksi class, that is, YS of 758 to 862 MPa (110 to 125 ksi)) and to 862 MPa class (125 ksi class, that is, YS of 862 to 965 MPa (125 to 140 ksi)), respectively.

A round bar tensile test piece with a parallel part diameter of 6.35 mm was taken from the wall thickness center part in the rolling longitudinal direction of each of the thus-obtained steel pipes, and subjected to a constant load type SSC test in the first environment or in the second environment with an applied stress of 90% of the actual YS. That is to say, the constant load type SSC test was carried out for 720 hours with an applied stress of 90% of the actual YS, with respect to 758 MPa-class, in the environment of 0.5% acetic acid+5% sodium chloride aqueous solution of 25° C. saturated with hydrogen sulfide of the partial pressure of 10132.5 Pa (0.1 atm) and, with respect to 862 MPa class, in the environment of 0.5% acetic acid+5% sodium chloride aqueous solution of 25° C. saturated with hydrogen sulfide of the partial pressure of 3039.75 Pa (0.03 atm). After the said SSC test, each surface appearance of the test pieces was checked in order to examine the existence of pitting.

The results of the SSC test are shown in Table 4 with YS and HRC hardness (Rockwell C hardness) as mechanical properties of each steel pipe.

TABLE 4

| Class. | Steel | Mechanical properties YS (MPa) | Mechanical properties YS [ksi] | Mechanical properties HRC | SSC test results in the first environment | Mechanical properties YS (MPa) | Mechanical properties YS [ksi] | Mechanical properties HRC | SSC test results in the second environment |
|---|---|---|---|---|---|---|---|---|---|
| Inventive Example | A | 861.9 | [125.1] | 30.1 | No cracking | 957.6 | [139.0] | 33.1 | No cracking |
| | B | 859.8 | [124.8] | 29.9 | No cracking | 960.4 | [139.4] | 33.5 | No cracking |
| | C | 862.6 | [125.2] | 30.2 | No cracking | 956.2 | [138.8] | 33.4 | No cracking |
| | D | 871.5 | [126.5] | 31.0 | No cracking | 961.1 | [139.5] | 33.5 | No cracking |
| | E | 861.9 | [125.1] | 30.8 | No cracking | 961.8 | [139.6] | 33.1 | No cracking |
| | F | 860.5 | [124.9] | 29.4 | No cracking | 968.0 | [140.5] | 34.0 | No cracking |
| | G | 864.6 | [125.5] | 30.1 | No cracking | 962.4 | [139.7] | 33.3 | No cracking |
| | H | 865.3 | [125.6] | 30.3 | No cracking | 956.9 | [138.9] | 33.8 | No cracking |
| | I | 859.8 | [124.8] | 29.8 | No cracking | 958.3 | [139.1] | 33.6 | No cracking |
| | J | 866.0 | [125.7] | 30.1 | No cracking | 968.6 | [140.6] | 34.1 | No cracking |
| | K | 870.1 | [126.3] | 31.2 | No cracking | 965.9 | [140.2] | 33.8 | No cracking |
| | L | 870.8 | [126.4] | 30.8 | No cracking | 963.8 | [139.9] | 33.1 | No cracking |
| | M | 855.0 | [124.1] | 29.1 | No cracking | 957.6 | [139.0] | 33.2 | No cracking |
| | N | 858.4 | [124.6] | 30.2 | No cracking | 953.5 | [138.4] | 32.5 | No cracking |
| | O | 853.6 | [123.9] | 28.4 | No cracking | 952.8 | [138.3] | 32.4 | No cracking |
| | P | 855.7 | [124.2] | 29.1 | No cracking | 960.4 | [139.4] | 33.1 | No cracking |
| Comparative Example | Q | 856.4 | [124.3] | 30.0 | Cracking | 962.4 | [139.7] | 33.1 | Cracking |
| | R | 852.9 | [123.8] | 28.7 | Cracking | 954.9 | [138.6] | 32.8 | Cracking |
| | S | 852.2 | [123.7] | 28.6 | Cracking | 953.5 | [138.4] | 33.1 | Cracking |
| | T | 858.4 | [124.6] | 29.4 | Cracking | 961.1 | [139.5] | 33.4 | Cracking |
| | U | 857.7 | [124.5] | 29.1 | Cracking | 959.0 | [139.2] | 34.2 | Cracking |
| | V | 853.6 | [123.9] | 28.3 | Cracking | 962.4 | [139.7] | 33.6 | Cracking |
| | W | 858.4 | [124.6] | 29.5 | Cracking | 959.7 | [139.3] | 33.4 | Cracking |
| | X | 850.2 | [123.4] | 28.7 | Cracking | 953.5 | [138.4] | 33.1 | Cracking |

In the YS column, the value in the [ ] means the value of "ksi" unit.

As is apparent from Table 4, the steels A to P manufactured by the method of the present invention were not fractured in the SSC test, and have the desired satisfactory SSC resistance. In these steels, no pitting was observed in the appearance check of the test piece surfaces performed after the SSC test.

On the other hand, the steels Q to X related to the comparative examples were fractured in the SSC test, and inferior in SSC resistance. Pittings were observed on the surface of the fractured test pieces, and it was confirmed that the fracture was started from the pitting.

Although only some exemplary embodiments of the present invention have been described in detail above, those skilled in the art will readily appreciated that many modifications are possible in the exemplary embodiments without materially departing from the novel teachings and advantages of the present invention. Accordingly, all such modifications are intended to be included within the scope of the present invention.

INDUSTRIAL APPLICABILITY

According to the method of the present invention, a low alloy steel having an extremely high SSC resistance with YS of not less than 758 MPa can be stably and surely obtained. The low alloy steel obtained by the method of the present invention can be used as steel stocks for casings or tubings for oil wells or gas wells, drill pipes or drill collars for drilling and further petroleum plant piping and the like, for which severe corrosion resistance, particularly severe SSC resistance, is requested.

What is claimed is:

1. A method for manufacturing a low alloy steel, excellent in corrosion resistance, which comprises adjusting the value of fn1 represented by the following expression (1), so as to satisfy the following expression (2), at the time of melting the said low alloy steel, which has a chemical composition by mass %, of C: 0.1 to 0.55%, Si: 0.05 to 0.5%, Mn: 0.1 to 1%, S: 0.0001 to 0.005%, Al: 0.005 to 0.08%, Ti: 0.005 to 0.05%, Cr: 0.1 to 1.5%, Mo: 0.1 to 1%, O (oxygen): 0.0004 to 0.005%, Ca: 0.0005 to 0.0045%, Nb: 0 to 0.1%, V: 0 to 0.5%, B: 0 to 0.005%, Zr: 0 to 0.10%, P: not more than 0.03%, and N: not more than 0.006%, with the balance being Fe and impurities:

$$fn1=([Ti]/47.9)([N]/14)/([Ca]/40.1) \quad (1),$$

$$0.0008 \leqq fn1 \leqq 0.0066 \quad (2),$$

wherein, Ca is added at the time of melting of the steel so that values of fn3 and fn4 represented by the following expressions (3) and (4) satisfy the following expressions (5) and (6), respectively:

$$fn3=WCa/[Ti] \quad (3),$$

$$fn4=WCa/[N] \quad (4),$$

$$2.7 \leqq fn3 \leqq 14 \quad (5),$$

$$10 \leqq fn4 \leqq 68 \quad (6),$$

wherein, reference marks in the expressions (1), (3) and (4) are defined as follows:

[Ca]: Ca content in molten steel by mass %,

[Ti]: Ti content in molten steel by mass %,

[N]: N content in molten steel by mass %,

WCa: adding amount of Ca per t (ton) of molten steel (kg/t).

* * * * *